US007949284B2

(12) United States Patent
Hirayama et al.

(10) Patent No.: US 7,949,284 B2
(45) Date of Patent: May 24, 2011

(54) IMAGE FORMING APPARATUS

(75) Inventors: Junya Hirayama, Takarazuka (JP); Toshiya Natsuhara, Takarazuka (JP); Takeshi Maeyama, Ikeda (JP); Shigeo Uetake, Takatsuki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 602 days.

(21) Appl. No.: 11/982,904

(22) Filed: Nov. 6, 2007

(65) Prior Publication Data

US 2008/0112733 A1 May 15, 2008

(30) Foreign Application Priority Data

Nov. 10, 2006 (JP) ..... 2006-304969

(51) Int. Cl.
*G03G 15/00* (2006.01)
*G03G 13/08* (2006.01)

(52) U.S. Cl. ..... 399/159; 430/123.41

(58) Field of Classification Search ..... 399/159, 399/109, 265; 430/123.41, 108.11
See application file for complete search history.

(56) References Cited

U.S. PATENT DOCUMENTS 4,921,768 A * 5/1990 Kunugi et al. ..... 430/45.1
5,710,962 A * 1/1998 Isoda et al. ..... 399/260
5,715,501 A * 2/1998 Aita et al. ..... 430/123.41
5,991,587 A 11/1999 Kikuchi
6,512,909 B2 1/2003 Ozawa et al.
6,721,516 B2 4/2004 Aoki et al.

FOREIGN PATENT DOCUMENTS

| | | |
|---|---|---|
| JP | 59-100471 | 6/1984 |
| JP | 09-185247 | 7/1997 |
| JP | 2000-298396 | 10/2000 |
| JP | 2002-108104 | 4/2002 |
| JP | 2003-057882 | 2/2003 |
| JP | 2003-215855 | 7/2003 |
| JP | 2005-189708 | 7/2005 |

* cited by examiner

*Primary Examiner* — David P Porta
*Assistant Examiner* — Faye Boosalis
(74) *Attorney, Agent, or Firm* — Brinks Hofer Gilson & Lione

(57) ABSTRACT

The present invention is intended to provide an image forming apparatus capable of producing high-quality images for a long period of time wherein the consumption of the opposite polarity particles is reduced, and a reduction in the amount of toner charge resulting from carrier deterioration is minimized, even if a great number of images having a low image area ratio were printed. This image forming apparatus is characterized in that the surface of an image carrying member, which is placed face to face with a toner carrying member, and on which an electrostatic latent image to be developed with the toner supported on the toner carrying member is formed, has an contact angle of 95 degrees or more with respect to pure water.

12 Claims, 2 Drawing Sheets

IMAGE FORMING APPARATUS

This application is based on Japanese Patent Application No. 2006-304969 filed on Nov. 10, 2006, in Japanese Patent Office, the entire content of which is hereby incorporated by reference.

TECHNICAL FIELD

The present invention relates to an image forming apparatus.

BACKGROUND

In an image forming apparatus based on electrophotographic method, a one-component developing system and a two-component developing system have been known, wherein the one-component developing system uses only toner as a developer in the development method for electrostatic latent image formed on an image carrying member, whereas the two-component developing system uses both toner and carrier.

In the one-component developing system, a toner carrying member and a regulating plate pressed against the toner carrying member are generally used. Control of film thickness is performed by pressing the toner on the toner carrying member by the regulating plate, thereby forming a thin toner layer charged with a predetermined amount of charge. An electrostatic latent image on an image carrying member is developed with this thin toner layer. This system is characterized by excellent dot reproducibility and effective production of uniform image with minimum irregularity. It is also considered to provide advantages in apparatus simplification, downsizing and cost-cutting. However, a heavy stress placed on the toner causes such a problem that the toner surface is degenerated, and toner or external additive agents are deposited on the surfaces of the toner regulating member or toner carrying member, with the result that fogging and contamination in the apparatus are caused both because of the poorly charged toner. As a result, the service life of the development apparatus will be reduced.

In the two-component developing system, on the other hand, toner is charged by triboelectric charging due to the mixture with a carrier. This is characterized by smaller stress and greater resistance to deterioration of toner. Further, as the carrier as a toner charging member has a greater surface area, it is relatively resistant to possible contamination by toner or external additive agents, whereby a longer service life can be expected.

However, when the two-component developer is utilized, contamination of the carrier surface is also caused by toner or external additive agents. The charge amount of toner will be reduced by a long-term use, and problems of fogging or toner splashing will arise. The service life is not sufficient, and prolonging the service life are desired.

One of the ways of prolonging the service life of the two-component developer is found in the Unexamined Japanese Patent Application Publication No. 59-100471, which discloses a development apparatus wherein a carrier is supplied little by little independently or together with toner, and the deteriorated developer of reduced charge is ejected in response to that, whereby the carrier is replaced by a new one, so that the percentage of the deteriorated carrier will be reduced. In this apparatus, the reduction in the toner charge due to carrier deterioration is kept to a predetermined level by replacement of the carrier. Thus, the service life is prolonged.

The Unexamined Japanese Patent Application Publication No. 2003-215855 discloses a two-component developer and a development method using the developer, the developer which is made up of the carrier and toner and is externally added opposite polarity particles having a polarity opposite. The opposite polarity particles in the development method act as abrasive powder and spacer particles, and are proved to have ability of reducing the deterioration of the carrier by the effect of removing the spent matters from the carrier surface.

The Unexamined Japanese Patent Application Publication No. H9-185247 discloses a so-called hybrid development method wherein the latent image on the image carrying member is developed using the toner carrying member that carries only toner from a two-component developer. The hybrid development method is characterized by the absence of irregularities on the image caused by a magnetic brush, and excellent dot reproducibility and image uniformity. Since there is no direct contact between the image carrying member and magnetic brush, there is no carrier movement to the image carrying member (carrier consumption). Thus, the hybrid development method has many advantages that cannot be expected in a conventional two-component developing system. In the hybrid development method, toner is charged by triboelectric charging with a carrier. The keeping of charge applying property is important for stabilizing the toner charging property and maintaining high image quality for a long period of time.

However, the Unexamined Japanese Patent Application Publication No. 59-100471 requires a mechanism to collect the ejected carrier and involves such problems as higher costs and environmental problems since the carrier is consumable. Further, as the printing operation in a predetermined amount must be done before the ratio of new carrier to old one is stabilized, initial characteristics cannot be kept for long. Further, in the Unexamined Japanese Patent Application Publication No. 2003-215855, when the area ratio of the image portion in the output image (image area ratio) is smaller, there is an increase in the amount of consumption of the opposite polarity particles on the non-image portion, as compared to the amount of consumption of the toner on the image portion on the image carrying member. When a great number of the images having a smaller image area ratio have been printed, there is a decrease in the amount of the opposite polarity particles in the development apparatus. Thus, the advantage of the opposite polarity particles for reducing the deterioration of the carrier cannot be fully demonstrated. This results in raising the problems of a reduction in the amount of toner charge and image deterioration. Further, the Unexamined Japanese Patent Application Publication No. H9-185247 has a problem that the carrier surface is contaminated by toner and postprocessing agent as the volume of printing increases, with the result that the charge applying property of the carrier is deteriorated.

SUMMARY

An object of the present invention is to provide an image forming apparatus capable of forming a high-quality image for a long period of time by reducing the consumption of opposite polarity particles and minimizing a reduction in the toner charge amount resulting from carrier deterioration, even when a great number of images having a smaller image area ratio are printed.

In view of forgoing, one embodiment according to one aspect of the present invention is an image forming apparatus, comprising:

a developer container which is adapted to contain a developer, the developer including:

a toner;

a carrier for charging the toner; and opposite polarity particles which are charged opposite to a charge polarity of the toner, a developer carrying member which is adapted to carry the toner supplied from the developer container;

a toner carrying member which is provided facing the developer carrying member and is adapted to receive the toner from the developer on the developer carrying member and convey the toner; and an image carrying member which is provided facing the toner carrying member and is adapted to carry an electrostatic latent image to be developed with the toner on the toner carrying member, wherein surface of the image carrying member has a contact angle of 95 degrees or more with respect to pure water.

DETAILED DESCRIPTION OF THE PREFERRED EMBODIMENT

Figure 1:
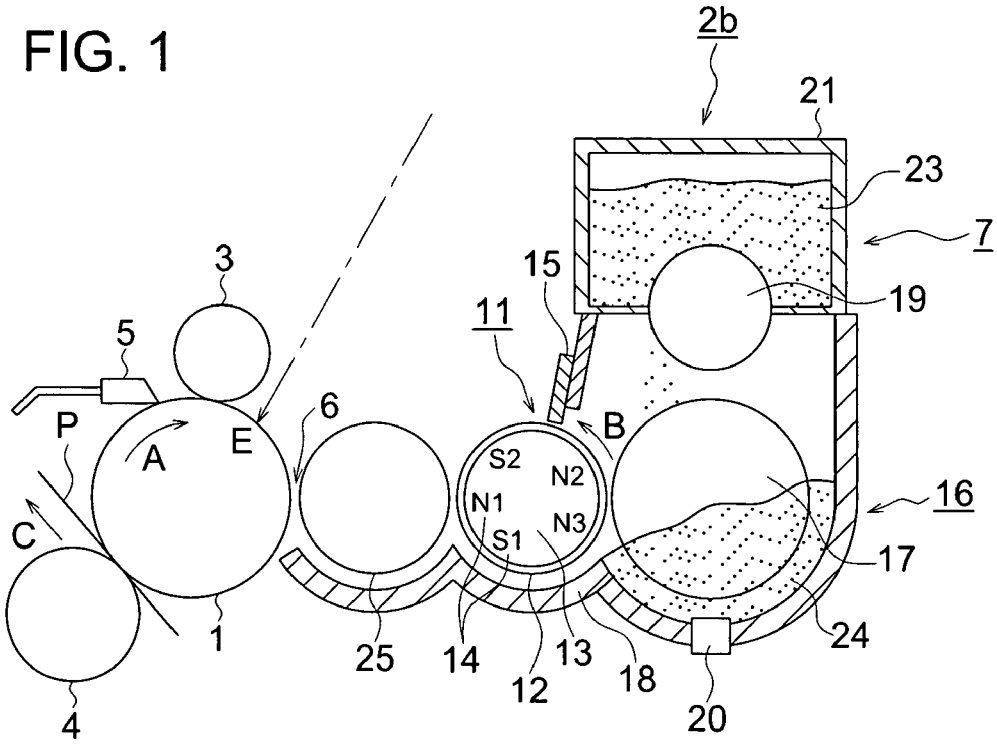
FIG. 1 is a drawing representing the major portions of the image forming apparatus as an embodiment of the present invention.

The following describes the embodiment of the present invention with reference to drawings:

FIG. 1 shows the major portions of the image forming apparatus as an embodiment of the present invention. This image forming apparatus is a printer in which the toner image formed on an image carrying member 1 by the electrophotographic method is transferred onto the transfer medium P such as paper, whereby image is formed. This image forming apparatus has an image carrying member 1 for carrying an image. Around the image carrying member 1, a charging device 3 for charging the image carrying member 1, a development apparatus 2 for developing the electrostatic latent image on the image carrying member 1, a transfer roller 4 for transferring a toner image of the image carrying member 1, and a cleaning blade 5 for removing toner remaining on the image carrying member 1 are arranged sequentially in the rotating direction A of the image carrying member 1.

After having been charged by the charging device 3, the image carrying member 1 is exposed to light by an exposure device (not illustrated) at position E in the drawing and an electrostatic latent image is formed on the surface thereof. The development apparatus 2 develops this electrostatic latent image into a toner image. A transfer roller 4 transfer the toner image on the image carrying member 1 onto a transfer medium P and then ejects the medium in the arrow-marked direction C. The cleaning blade 5 removes the toner remaining on the image carrier 1 subsequent to the transfer by a mechanical force. Any desired technology of the well known electrophotographic technology can be used for the image carrying member 1, the charging device 3, the exposure device, the transfer roller 4, the cleaning blade 5. For example, although a charging roller is shown in FIG. 1 as the charging device, a charging apparatus not in contract with the image carrying member 1 can be used. Alternatively, a cleaning blade, for example, need not be used.

In the embodiment, the development apparatus 2 includes a developer container 16 for storing the developer 24, a developer carrying member 11 for carrying on the surface the developer 24 supplied from the developer container and conveying the developer 24, and a toner carrying member 25 for separating the toner from the developer on the developer carrying member.

In the embodiment, the developer 24 includes toner, a carrier for charging the toner, and opposite polarity particles.

The toner carrying member 25 is provided between the developer carrying member 11 and image carrying member 1. When toner separating bias is applied, the toner in the developer is electrically separated and carried by the toner carrying member 25. The toner separated and carried by the toner carrying member 25 is conveyed by the toner carrying member 25, and develops the electrostatic latent image on the image carrying member 1 in the development area 6.

In the meantime, the opposite polarity particles are given electric force by the toner separation bias in the direction of remaining on the developer carrying member 11, and almost all these particles are collected into the developer container 16.

The opposite polarity particles can be charged opposite to the polarity of the toner according to the carrier used. For example, when toner is negatively charged by the carrier, the opposite polarity particles are positively charged in the developer. For example, when toner is positively charged by the carrier, the opposite polarity particles are negatively charged in the developer. When opposite polarity particles are included in the two-component developer, as the opposite polarity particles are accumulated in the developer by a separation device with the process of time, even if the carrier charging property is reduced by of the toner or post-processing agent spent to the carrier, the opposite polarity particles can charge the toner to the right polarity. Accordingly, the reduction in carrier charging property can compensate effectively, with the result that the deterioration of the carrier is minimized. The number average particle diameter of the opposite polarity particles is preferably in the range of 100 through 1000 nm.

The opposite polarity particles are appropriately selected by toner charging property. When negatively charged toner is used, positively charged particles are used as the opposite polarity particles. For example, it is possible to use inorganic particles such as strontium titanate, barium titanate and alumina, and particles made of thermoplastic or thermosetting resin such as acryl resin, benzoguanamine resin, nylon resin, polyimide resin and polyamide resin and others. Further, a positive charge control agent for positive charging may be contained in the resin, or the copolymer of nitrogen-containing monomer may be formed. In this case, a nigrosine dye or quaternary ammonium salt can be used as the aforementioned positive charge control agent. Further, 2-dimethylaminoethyl acrylate, 2-diethylaminoethyl acrylate, 2-dimethylaminoethyl methacrylate, 2-diethylaminoethyl methacrylate, vinyl pyridine, N-vinyl carbazole and vinyl imidazole can be used as the aforementioned nitrogen-containing monomer.

When the positively charged toner is used, negatively charged particles are used as the opposite polarity particles. For example, the particles made up of the thermoplastic or thermosetting resin such as fluorine resin, polyolefin resin, silicone resin and polyester resin can be used in addition to the inorganic particles such as silica and titanium oxide. Further, the negative charge control agent for negative charging can be contained in the resin, or a copolymer of fluorine-containing acryl based monomer and fluorine-containing methacryl based monomer can be formed. In this case, salicylic acid based or naphthol based chromium complex, aluminum complex, iron complex, zinc complex and others can be used as the aforementioned negative charge control agent.

Further, to regulate the charging properties and hydrophobicity of the opposite polarity particles, the inorganic particle can be surface-treated by silane coupling agent, titanium coupling agent, silicone oil and others. Particularly when the inorganic particle is positively charged, an amino group-containing coupling agent is preferably used for surface treatment. When the inorganic particle is negatively charged, a fluorine-containing coupling agent is preferably used for surface treatment.

There is no particular restriction to the toner to be used. A conventionally known toner can be used. A coloring agent, or if required, charge control agent or mold releasing agent can be contained in the binder resin, and the external additive agent can be used for processing. The toner particle size is preferably in the range of about 3 through 15 μm without being restricted thereto.

When manufacturing such toner, a conventionally known method can be used. For example, the toner can be manufactured by pulverization, emulsion polymerization or suspension polymerization method.

A conventionally known agent can also be used as the aforementioned external additive agent. It is possible to use a fluidity improvement agent as exemplified by the inorganic particles such as silica, titanium oxide and aluminum oxide, or the resin particles such as acryl resin, styrene resin, silicone resin and fluorine resin. It is especially preferred to use the agent which is hydrophobed by silane coupling agent, titanium coupling agent or silicone oil. It is preferable that 0.5 through 5 parts by mass of such a fluidity improvement agent is added to 100 parts by mass of the aforementioned toner.

There is no particular restriction to the type of the carrier. A conventionally known carrier can be used. A binder type carrier, coat type carrier and others can be utilized. The carrier particle size is preferably in the range of 15 through 100 μm although there is no particular restriction to the carrier particle size.

In the meantime, the coat type carrier is formed by coating resin on the carrier core particle made of a magnetic body. Similarly to the case of the binder type carrier, the coat type carrier can be produced by fixing the positively or negatively charged particles onto the carrier surface. The charging property of the coat type carrier can be controlled by the type of the surface coating layer and electrostatic particles.

Figure 2:
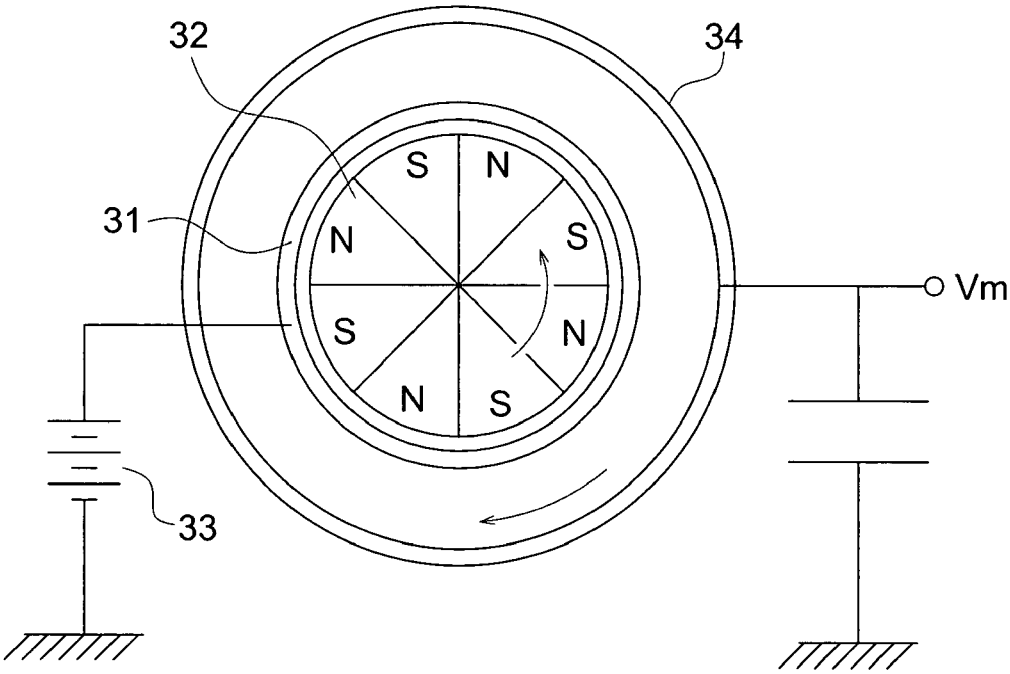
FIG. 2 is a schematic configuration diagram representing an apparatus for measuring the amount of charged particles.

The charge polarity of the toner and the opposite polarity particles charged by combination of opposite polarity particles and toner can be easily identified from the direction of the electric field when the toner or opposite polarity particles is separated from the developer using an apparatus of FIG. 2 after they have been mixed and stirred and have been made into a developer. FIG. 2 is a schematic view of the apparatus for measuring the amount of charge of electrostatic particles such as toner.

To be more specific, in the apparatus of FIG. 2, the developer made up of toner, carrier and opposite polarity particles are uniformly placed over the entire surface of the conductive sleeve 31. Then the speed of the magnet roll 32 arranged inside this conductive sleeve 31 is set at 1000 rpm, and the bias voltage of 2 kV is applied to the same polarity as that of the toner charging potential by the bias power source 33. When the aforementioned conductive sleeve 31 is stopped after it is rotated for 15 seconds, the potential Vm on the cylindrical electrode 34 is read. At the same time, the mass of toner deposited on the cylindrical electrode 34 is measured by a precision balance, whereby the amount of toner charge can be obtained.

The polarity of the toner and the particles except the toner can be identified by the polarity of the bias voltage applied from the bias power source 33. To be more specific, when the bias voltage of opposite polarity to the that of toner is applied, the particles deposited on the cylindrical electrode 34 have the polarity opposite to the toner charged polarity, namely, they are the opposite polarity particles.

The blending ratio between the toner and carrier can be adjusted so that a desired amount of toner charge will be obtained. The appropriate ratio of toner is in the range of 3 through 50% by mass, preferably 6 through 30% by mass with respect to the total amount of toner and carrier.

There is no particular restriction to the amount of the opposite polarity particles contained in the initial developer. For example, the preferred amount is in the range of 0.01 through 5.00% by mass, particularly 0.01 through 2.00% by mass with respect to the carrier.

It is preferred that the developer should be prepared by being blended with the carrier after opposite polarity particles have been externally added to toner in advance.

The developer carrying member 11 is made up of a magnetic roller 13 fixed and arranged in position, and a freely rotatable sleeve roller 12 incorporating the magnetic roller. The magnetic roller 13 has five magnetic poles—N1, S1, N3, N2, S2—in the rotating direction B of the sleeve roller 12. Of these magnetic poles, the main magnetic pole N1 is located in the development area 6 face to face with the image carrying member 1. The homopolar sections N3 and N2 for generating the repulsive magnetic field to separate the developer 24 on the sleeve roller 12 are arranged at the position opposing to the inside of the development tank 16.

The developer container 16 is formed of a casing 18. Normally, it incorporates a bucket roller 17 for supplying a developer to the developer carrying member 11. An ATDC (Automatic Toner Density Control) sensor 20 for detecting toner density is preferably arranged at the position, in the casing 18, opposite the bucket roller 17.

The development apparatus 2 has a replenishment section 7 for replenishing into the developer container 16 the amount of toner consumed in the development area 6, and a regulating member (regulating blade) 15 for reducing the thickness of the developer layer for regulating the amount of developer on the developer carrying member 11. The replenishment section 7 is made up of a hopper 21 for accommodating the supply toner 23, and a replenishment roller 19 for replenishing toner into the developer container 16.

The toner with opposite polarity particles externally added thereto is preferably used as a supply toner 23. When using the toner with opposite polarity particles externally added thereto, it is possible to effectively make up for the reduction in the carrier charging property which is deteriorated with the process of time. The preferred amount of the opposite polarity particles to be added externally in the supply toner 23 is in the range of 0.1 through 10.0% by mass, particularly 0.5 through 5.0% by mass, with respect to toner.

The toner separation bias applied to the toner carrying member 25 is varied according to the toner changed polarity. To be more specific, when the toner is negatively charged, the bias applied is the average voltage higher than that of the voltage applied to the developer carrying member. When the toner is positively charged, the bias applied is the average voltage lower than that of the voltage applied to the developer carrying member. Independently of whether toner is charged positively or negatively, the difference between the average voltage applied to the toner carrying member and the average voltage applied to the developer carrying member is preferably in the range of 20 through 500 V, particularly 50 through 300 V. If the potential difference is too small, toner cannot be separated sufficiently. If the potential difference is excessive, the carrier held by magnetic force on the developer carrying member will be separated by electric field, and the expected development function will be deteriorated in the development area.

In the development apparatus 2, an AC electric field is preferably formed between the toner carrying member 25 and the developer carrying member 11. If the AC electric field is formed, toner will start back-and-forth oscillation, and can be effectively separated. In this case, the field of $2.5\times10^6$ V/m or more is preferably formed. When the field of $2.5\times10^6$ V/m or more is preferably formed, toner can be separated from the developer carrying member by the electric field as well, and this signifies a further improvement in separation of toner.

In the Specification, the electric field formed between the toner carrying member 25 and the developer carrying member 11 is referred to as the toner separation field. The toner separation field can be normally obtained by application of AC voltage to the toner carrying member 25 and/or the developer carrying member 11. Specifically, when AC voltage is applied to the toner carrying member 25 to develop the electrostatic latent image with toner, the toner separation field is preferably formed using the AC voltage applied to the toner carrying member 25. In this case, the toner separation field is only required to meet the requirement that the maximum absolute value is $2.5\times10^6$ V/m or more.

For example, when the toner charge polarity is positive, DC voltage and AC voltage are applied to the developer carrying member, and DC voltage alone is applied to the toner carrying member, the DC voltage alone lower than the average value of the voltages (DC+AC) applied to the developer carrying member is applied to the toner carrying member. Further, for example, when the toner charge polarity is negative, DC voltage and AC voltage are applied to the developer carrying member, and DC voltage alone is applied to the toner carrying member, the DC voltage alone higher than the average value of the voltages (DC+AC) applied to the developer carrying member is applied to the toner carrying member. In such cases, the maximum absolute value of the toner separation field is obtained by dividing the maximum value of the potential difference between the voltage (DC+AC) applied to the developer carrying member and the voltage (DC) applied to the toner carrying member, by the gap of the closest portion between the toner carrying member and developer carrying member. The aforementioned value is preferably within above-identified range.

Further, for example, when the toner charge polarity is positive, the DC voltage alone is applied to the developer carrying member, and AC field and DC voltage are applied to the toner carrying member, the DC voltage superimposed with AC field so as to get the average voltage lower than the DC voltage applied to the developer carrying member is applied to the toner carrying member. Further, for example, when the toner charge polarity is negative, the DC voltage alone is applied to the developer carrying member, and AC field and DC voltage are applied to the toner carrying member, the DC voltage superimposed with the AC field so as to get the average voltage higher than the DC voltage applied to the developer carrying member is applied to the toner carrying member. In such cases, the maximum value of the toner separation field is obtained by dividing the maximum value of the potential difference between the voltage (DC) applied to the developer carrying member and the voltage (DC+AC) applied to the toner carrying member, by the gap of the closest portion between the toner carrying member and the developer carrying member. The aforementioned value preferably lies in the range of the electric field of $2.5\times10^6$ V/m or more.

Further, for example, when the toner charge polarity is positive, and DC voltage superimposed with the AC voltage is applied to both the developer carrying member and the toner carrying member, the voltage (DC+AC) whose average voltage is smaller than that of the voltage (DC+AC) applied to the developer carrying member is applied to the toner carrying member. Further, for example, when the toner charge polarity is negative, and DC voltage superimposed with the AC voltage is applied to both the developer carrying member and the toner carrying member, the voltage (DC+AC) whose average voltage is greater than that of the voltage (DC+AC) applied to the developer carrying member is applied to the toner carrying member. In such cases, the value obtained by dividing the maximum potential difference, which is caused by the difference in the amplitude, phase, frequency and duty ratio of the AC voltage component applied to each of them, by the gap at the closest portions between the toner carrying member and developer carrying member, is the maximum absolute value of the toner separation field. This value is preferably the electric field of $2.5\times10^6$ V/m or more.

There is no particular restriction to the material constituting the toner carrying member 25 as long as the aforementioned voltage can be applied. The material is exemplified by aluminum roller provided with surface treatment. It is also possible to use a conductive substrate of aluminum and others, coated with resins such as polyester resin, polycarbonate resin, acryl resin, polyethylene resin, polypropylene resin, urethane resin, polyamide resin, polyimide resin, polysulfone resin, polyether ketone resin, polyvinyl chloride resin, vinyl acetate resin, silicone resin and fluorine resin; or coated with rubbers such as silicone rubber, urethane rubber, nitrile rubber, natural rubber, and isoprene rubber, without the coating material being restricted thereto. Further, a conductive agent can be added to the aforementioned coated bulk or surface. An electric conductive agent or ion conductive agent can be mentioned as the conductive agent. The electric conductive agent can be exemplified by carbon black such as ketchin black, acetylene black and furnace black, and particles such as metal powder and metal oxide, without being restricted thereto. The ion conductive agent is exemplified by a cationic compound such as quaternary ammonium salt, amphoteric compound, and other ionic polymer materials, without being restricted thereto. A conductive roller made up of a metallic material such as aluminum can also be used.

Figure 3:
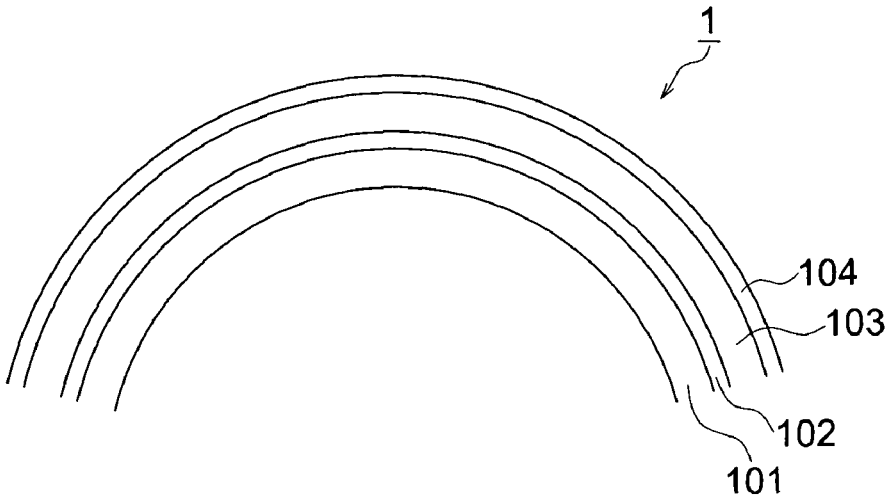
FIG. 3 is a diagram schematically showing the structure of the image carrying member of the present invention.

FIG. 3 schematically illustrates the structure of the image carrying member 1.

The image carrying member (photoconductor) 1 is formed of an aluminum cylindrical substrate (conductive supporting member) 101 on which an underlying layer 102, photosensitive layer 103 and overcoat layer 104 serving as a surface layer of the image carrying member 1 are formed sequentially in that order. The photosensitive layer 103 can be a function-separated type layer made up of a charge generation layer followed by a charge transport layer. It can be either a function-separated type layer or a single layer type layer wherein a charge generation material and charge transport layer are dispersed in resins. The following describes the function-separated type image carrying member 1.

In the first place, a charge generation layer is formed on a conductive supporting member. The charge generation layer is formed by vacuum deposition of a charge generation material, by coating and drying the charge generation material dissolved in amine based solvent, or by coating and drying the coating solution prepared by dispersing the charge generation material in a solution in which appropriate solvent or, if required, binder resin is dissolved. The thickness of the charge generation layer is preferably in the range of 0.01 through 5 μm, more preferably in the range of 0.1 through 2 μm.

The examples of the conductive supporting member 101 include an ED tube produced by extrusion followed by cold drawing; a cut tube produced by cutting an aluminum pipe produced by extrusion followed by cold drawing, wherein the outer surface is cut by about 0.2 through 0.3 mm using a cutting tool such as a diamond tool; an EI tube produced by forming an aluminum disk into a cup by impact processing wherein the outer surface is finished by ironing thereafter; and a DI tube produced by deep drawing of an aluminum disk wherein the outer surface is finished by ironing thereafter. These examples also include the products wherein these surfaces are further machined, are subjected to anode oxidation, or pore-sealing after anode oxidation.

Prior to formation of a charge generation layer, an underlying layer 102 can be formed on the conductive supporting member 101 to prevent electric charge from being injected from the conductive supporting member. When the underlying layer is provided, the appropriate materials include the resin that can be dissolved in water or alcohol as exemplified by polyamide, polyvinyl alcohol, copolymerized nylon; the curable resin such as polyurethane and epoxy resin; or the material dispersed with low-resistance compounds such as tin oxide and indium oxide. In this case, the preferred film thickness of the underlying layer is 1 μm or less.

The examples of the charge generation material include a bisazo pigment, pyrylium dye, azo dye, polyethylene dye, squalane dye, and phthalocyanine pigment.

When the charge generation layer is formed by dispersing the charge generation material in the binder resin, the appropriate amount of charge generation material contained in this layer is in the range of 10 through 400 parts by mass, preferably in the range of 50 through 250 parts by mass, with respect to 100 parts by mass of binder resin. In this case, the examples of the binder resin include a thermoplastic resin such as butylal resin (polyvinyl butylal) and polyester resin; and a thermosetting resin such as epoxy resin, alkyd resin, urethane resin, silicone resin and phenol resin.

This is followed by the step of forming a charge transport layer. The charge transport layer is formed by coating the aforementioned charge generation layer with a coating solution containing at least a charge transport generation material, binder resin and organic solvent, and by drying the layer. The thickness of the charge transport layer is preferably in the range of 4 through 50 μm, more preferably in the range of 10 through 30 μm.

The charge transport material that can be used to form a charge transport layer is exemplified by hydrazone compound, styryl compound, stilbene compound, triphenylamine compound, and tetraphenyl benzidine compound. They can be used independently, or two or more of them can be used in combination. The amount of the charge transport material contained is preferably in the range of 2 through 200 parts by mass, more preferably in the range of 50 through 120 parts by mass, with respect to 100 parts by mass of binder resin. The binder resin used to form a charge transport layer is exemplified by polycarbonate resin, polyester resin and polyarylate resin. A phenol or amine based antioxidant is preferably added in order to minimize deterioration in durability.

This is followed by the step of forming the overcoat layer as a surface layer of the image carrying member 1. The contact angle of the overcoat layer surface with respect to pure water is 95 degrees or more. When the contact angle of the overcoat layer surface with respect to pure water is 95 degrees or more, almost all the opposite polarity particles remain within the development apparatus without being ejected (consumed) out of the development apparatus 2, even when a large number of images with smaller image area ratio as an image pattern are printed. As a result, the opposite polarity particles are mixed with the developer and are stirred in the developer container 16, thereby contributing to charging of the toner. This arrangement prevents the amount of toner charge from being reduced due to deterioration of the carrier.

The following describes the mechanism wherein the opposite polarity particles are not ejected from the development apparatus 2 when the contact angle of the surface of the image carrying member 1 with respect to the pure water is 95 degrees or more.

First, the mechanism in which opposite polarity particles are ejected from the development apparatus 2 is explained as follows.

When the image to be printed has a lower image area ratio, the non-image area in the surface of the image carrying member 1 is increased. In the non-image area, the electric field is formed in the direction wherein toner on the toner carrying member is not moved. If opposite polarity particles are present in the development area 6, the force to move the opposite polarity particles onto the non-image area will be applied. Under ordinary circumstances, the opposite polarity particles are drawn onto the developer carrying member 11 by the toner separation bias applied between the toner carrying member 25 and developer carrying member 11, and almost all the particles return to the development tank 16. However, the size of the opposite polarity particles is in the order of submicron, and some of them are deposited on the toner mainly by the van del Waals attraction. Thus, even when the separation bias as Coulomb force is applied, part of the opposite polarity particle moves to the toner carrying member 25, without being separated from the toner. In the development area 6, the force is applied in such a way that the opposite polarity particles having moved to this toner carrying member 25 are deposited in the non-image area. At this time, part of the opposite polarity particles are separated from the toner by the oscillation field of the development area 6 and the force of impact resulting from traveling of toner in the development area 6, and are deposited in the non-image area. Thus, the opposite polarity particles are consumed from the development apparatus 2. The amount of consumption increases with the number of printed sheets, even if the amount of toner consumption is smaller. The replenishment of the opposite polarity particles included in the supply toner is not sufficient to make up for the deficit. This leads to reduction in the amount of toner charge.

Paying attention to the surface energy of the image carrying member 1, the present inventors considered that less opposite polarity particles are deposited in the non-image area as the contact angle of the surface of the image carrying member 1 with respect to water is greater, and have found out that the opposite polarity particles are hardly deposited in the non-image area at the contact angle of 95 degrees or more. This is because, when the particles together with toner are moved in the back-and-forth direction between the image carrying member 1 and toner carrying member 25 in the development area 6 by the oscillation electric field, the opposite polarity particles deposited on the toner go back to the toner carrying member 25, instead of moving to the image carrying member 1, if the contact angle of the image carrying member 1 is large. Even if the particles are separated from the toner, they are again brought in contact with the toner and are deposited on the toner and go back to the toner carrying member 25. As a result, the opposite polarity particles are not consumed from the development apparatus 2. Thus, there is no problem if the contact angle of the image carrying member 1 is 95 degrees or more.

The following describes the method of measuring the contact angle with respect to pure water on the surface of the image carrying member 1.

Measuring instrument: Contact angle meter CA-X roll type (by Kyowa Kaimen Kagakusha Co., Ltd.)

Liquid dropping speed: 10 μl/sec.

Amount of liquid drop; 5 μl

Figure 4:
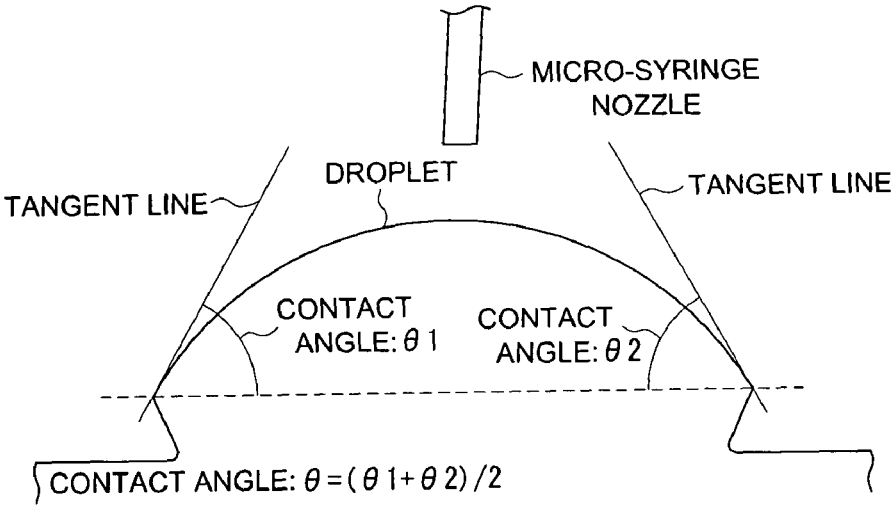
FIG. 4 is a diagram representing the method of measuring a contact angle.

Number of measurements: n=5 measurements on the same surface at different liquid drop points Procedure: 5 μl of pure water was dropped onto the test piece from a micro-syringe, and the contact angle=(θ1+θ2)/2 was measured at the room temperature according to the shape of the liquid droplet 30 seconds after dropping. FIG. 4 shows the example of measuring on the surface of the image carrying member 1.

The overcoat layer was formed by coating the aforementioned charge transport layer with the coating solution including fluorine resin particles, charge transport material, binder resin and organic solvent, and by drying the same.

The thickness of the overcoat layer is in the range of 0.1 through 10 μm, preferably in the range of 0.5 through 8 μm.

The examples of the binder resin that can be used to form the overcoat layer include a thermoplastic resin such as polyester resin, polyamide resin, ethylene-vinyl acetate resin, polycarbonate resin, polyimide resin, and cellulose ester resin; and a thermosetting resin such as epoxy resin and alkyd resin. They can be used independently, or two or more of them can be used in combination. The specific examples of the fluorine resin particles include an independent polymer or copolymer formed by polymerization of one or more monomers selected from among the groups made up of the tetrafluoroethylene, vinylidene fluoride, hexafluoropropylene and trifluorochloroethylene. To enhance wear resistance and release characteristics, fluorine resin particles are preferably made up of polytetrafluoroethylene, polyvinylidene fluoride or polyhexafluoropropylene, more preferably polytetrafluoroethylene.

To minimize the image noise and deterioration of photoconductor sensitivity, the size of the aforementioned fluorine resin particle is in the range of 0.01 through 2 μm, preferably 0.05 through 1.0 μm. In the present specification, the term "particle size" signifies the average primary particle size and is represented by the value measured by the particle size distribution measuring instrument LA920 (by Horiba Seisakujo Co., Ltd.).

The amount of contained fluorine resin particles is preferably in the range of 1 through 40% by mass, more preferably 10 through 35% by mass, with respect to the total amount of the overcoat layer. Two or more types of fluorine resin particles can be used in combination. In this case, the total amount is only required to be kept within the aforementioned range. When the amount contained is less than 1% by mass, these particles cannot easily been uniformly dispersed on the layer obtained. This makes it difficult to maintain desired effects for a long period of time. In the meantime, if the amount contained exceeds 40% by mass, the photoconductor sensitivity will deteriorate.

According to the image forming apparatus of the embodiment, even when a great number of images having a smaller image area ratio have been printed, the image forming apparatus of the embodiment, minimizes the consumption of opposite polarity particles in the image carrying member and the reduction in the amount of toner charge due to carrier deterioration, and provides a high-quality image for a long period of time.

EXAMPLE

The following describes the toner used in the example:

0.2 parts by mass of the first hydrophobic silica, 0.5 parts by mass of the second hydrophobic silica and 0.5 parts by mass of hydrophobic titanium oxide were externally added to 100 parts by mass of toner base material having a particle size of 6.5 μm prepared by the wet palletizing method by surface treatment at a speed of 40 m/s for three minutes using the Henschel mixer (by Mitsui Mining and Smelting Co., Ltd.).

The first hydrophobic silica used here was prepared by surface treatment of silica (#130 by Nippon Aerosil Co., Ltd.) having an average primary particle size of 16 nm, using the hexamethyldisilane (HMDS) as a hydrophobing agent. Further, the second hydrophobic silica was obtained by surface treatment of silica (#90G by Nippon Aerosil Co., Ltd.) having an average primary particle size of 20 nm, using hexamethyldisilazane (HMDS). The hydrophobic titanium oxide was obtained by surface treatment of the anatase type titanium oxide having an average primary particle size of 30 nm in an aqueous wet environment, using the isobutyltrimethoxy silane as a hydrophobing agent.

Toner was prepared by external addition of 2 parts by mass of the strontium titanate as opposite polarity particles having an average primary particle size of 350 nm with respect to 100 parts by mass of toner base material particles at a speed of 40 m/s for three minutes, similarly using the Henschel mixer.

Example 1

The following describes the photoconductor used in the Example 1:

The surface of the JIS 5657 cylindrical aluminum alloy (having an outer diameter 30 mm with a thickness of 1 mm) was machined using a cutting tool with a natural diamond employed as a cutting blade. After that, this alloy was degreased and was rinsed in running water. It was then anode-oxidized to form an anodized layer having a thickness of 8 μm. This was rinsed by running pure water and was then subjected to pore sealing using a pore sealing agent containing nickel acetate, thereby obtaining a photoconductor substrate wherein the anodized layer was pore-sealed in this manner. The following describes the procedure of forming the photosensitive layer:

One part of butylal resin (ESREC BX-1 by Sekisui Chemical Co., Ltd.) and one part of titanyl phthalocyanine (am-TiOPc by Toyo Ink Mfg. Co., Ltd.) were added to 100 parts of tetrahydrofuran. The mixture was dispersed by a sand mill for five hours to prepare a coating solution for the charge generation layer. The aforementioned supporting member was immersed in this coating solution for charge generation layer and was coated, thereby preparing a charge generation layer having a film thickness of 0.2 μm. 100 parts of polycarbonate resin (Panlite TS-2020 by Teijin Chemical Industries Co., Ltd.), 70 parts of styryl compound as a charge transport agent, and 8 parts of phenol compound butylhydroxy toluene were dissolved in 1000 parts of tetrahydrofuran, whereby the coating solution for charge transport layer was prepared. The aforementioned charge generation layer was immersed in the coating solution for charge transport layer and is coated. This was dried by air blast, whereby a charge transport layer having a film thickness of 20 μm was prepared.

70 parts of polytetrafluoroethylene (KTL-500F by Kitamura Co., Ltd., with a particle size of 0.3 μm) as fluorine resin particles were suspended in 1000 parts of tetrahydrofuran. Then the mixture was dispersed by a sand grinder for five hours, whereby a dispersion of fluorine resin particle was prepared. Then 100 parts of polycarbonate resin (Panlite TS-2020 by Teijin Chemical Industries Co., Ltd., with a friction coefficient of 0.35), 100 parts of styryl compound, and 8 parts of phenol compound butylhydroxy toluene were dissolved in 4000 parts of tetrahydrofuran. After that, 1090 parts of the aforementioned dispersion of fluorine resin particles were dispersed by ultrasonic wave for 30 minutes, whereby a coating solution for overcoating was prepared. This coating solution for the overcoat layer was coated using a ring coating apparatus, and the layer was dried for 40 minutes at 100 degrees Celsius to yield an overcoat layer having a film thickness of 5 μm, whereby the electrophotographic photoconductor of the example was produced.

In the photoconductor of the Example 1, the contact angle of the overcoat layer surface with respect to pure water was 95 degrees. The contact angle was measured by an angle meter CA-X roll type (by Kyowa Kaimen Kagakusha Co., Ltd.).

A development apparatus of FIG. 1 and a carrier for bizhub C350 (particle size around 33 μm) by Konica Minolta were used for a developer, and the toner ratio in the developer was 8% by mass. A DC voltage of −400 volts was applied to the developer carrying member. A rectangular development bias having a peak-to-peak voltage of 1.6 kV with a DC component of −300 V, a duty ratio of 50% and a frequency of 2 kHz was applied to the toner carrying member. The average potential of the toner carrying member had a potential difference of 100 volts with respect to the potential of the developer carrying member. The maximum potential difference is a potential difference of 900 volts. An aluminum roller whose surface was provided with alumite treatment was used as the toner carrying member, and the gap of the closest portion between the developer carrying member and toner carrying member was 0.3 mm. The electrostatic latent image formed on the image carrying member 1 had a background potential of −550 volts, the image portion had a potential of −60 volts, and the gap of the closest portion between the image carrying member 1 and toner carrying member 25 was 0.15 mm. The maximum absolute value of the toner separation field formed between the toner carrying member 25 and developer carrying member 11 was 900 V/0.3 mm=$3.0\times10^6$ V/m. The aforementioned image carrying member whose overcoat layer contains the fluorine resin particles was used as an image carrying member.

Example 2

The same conditions as those in Example 1 were used except that the amount of the polytetrafluoroethylene of the overcoat layer of the image carrying member 1 was 100 parts. To be more specific, the contact angle of the surface of the image carrying member 1 with respect to pure water used in Example 2 was 105 degrees.

Comparative Example 1

The same conditions as those in Example 1 were used except that the image carrying member 1 without overcoat layer was employed. Since there was no overcoating, a layer having a thickness of 25 μm was used as the charge transport layer of the image carrying member 1. The contact angle of the surface layer of the image carrying member 1 with respect to pure water was 80 degrees.

(Evaluation 1)

Ten A4-sized sheets in landscape orientation with an image area ratio of 0% (white paper) were printed together with the aforementioned Examples and Comparative example. The operation was forcibly suspended in the middle of formation of the image with an area ratio of 0% on the 11th sheet. The opposite polarity particles adhering to the image carrying member 1 subsequent to development and prior to transfer were observed at four positions using a scanning electron microscope (SEM), and then comparison was made. The result of the observation is given in Table 1. In the observation, the surface of the image carrying member 1 was magnified by 20,000 times by the SEM, and the numbers of the opposite polarity particles per screen were compared.

TABLE 1

| No. | Example 1 | Example 1 | Comparative example |
|---|---|---|---|
| 1 | 23 | 18 | 78 |
| 2 | 19 | 17 | 95 |
| 3 | 18 | 15 | 81 |
| 4 | 21 | 19 | 79 |

It can be seen that the number of opposite polarity particles deposited on the image carrying member 1 is smaller in Examples 1 and 2 than in Comparative example 1. This shows that, when the contact angle of the surface of the image carrying member with respect to pure water is 95 degrees or more, opposite polarity particles do not easily adhere to the non-image portion of the image carrying member.

(Evaluation 2)

A durability test of 50,000 sheets was conducted in both the aforementioned Examples 1 and 2, and Comparative example 1, wherein the image area ratio was 3%. Table 2 demonstrates the amount of toner charge before and after the test.

TABLE 2

| Number of printed sheets | Amount of toner charge (−μC/g) Beginning | 50,000 sheets | Change in the amount of toner charge (−μC/g) |
|---|---|---|---|
| Example 1 | 33.0 | 32.5 | −0.5 |
| Example 2 | 31.5 | 31.0 | −0.5 |
| Comparative example 1 | 32.3 | 27.7 | −4.6 |

It can be seen that the charging performance was maintained in the Examples 1 and 2 although a slight reduction was observed in Comparative example 1. Whereas a slight fogging was observed on the images after 50,000 printings in the Comparative example 1, no fogging was observed in Examples 1 and 2.

As described above, when the surface of the image carrying member had a contact angle of 95 degrees or more with respect to pure water, the consumption of the opposite polarity particles could be minimized, and a reduction in the amount of toner charge resulting from carrier deterioration could be made up for by opposite polarity particles, even if a great number of images having a low image area ratio were printed. This arrangement provides an image forming apparatus capable of producing high-quality images for a long period of time.

What is claimed is:

1. An image forming apparatus, comprising:

a developer container which is adapted to contain a developer, the developer including:

a toner;

a carrier with which the toner is triboelectrically charged; and opposite polarity particles which are charged by the carrier, to a polarity opposite that of the toner;

a developer carrying member which is adapted to carry the developer supplied from the developer container;

a toner carrying member, which is provided facing the developer carrying member and is adapted to receive the toner from the developer on the developer carrying member and convey the toner; and an image carrying member, which is provided facing the toner carrying member and is adapted to carry an electrostatic latent image to be developed with the toner on the toner carrying member, wherein a surface of the image carrying member has a contact angle of 95 degrees or more with respect to pure water.

2. The image forming apparatus of claim 1, wherein a surface layer of the image carrying member includes fluorine resin particles.

3. The image forming apparatus of claim 1, wherein the image carrying member includes a photoconductor.

4. The image forming apparatus of claim 3, wherein the image carrying member includes from the inside outward:

a conductive supporting layer;

a photoconductive layer; and an overcoat layer.

5. The image forming apparatus of claim 4, wherein the overcoat layer includes fluorinated resin particles.

6. The image forming apparatus of claim 5, wherein the fluorinated resin particles have a particle diameter from 0.01 to 2.00 μm.

7. The image forming apparatus of claim 6, wherein the fluorinated resin particles have a particle diameter from 0.05 to 1.00 μm.

8. The image forming apparatus of claim 5, wherein a content of the fluorinated resin particles ranges from 1% to 40% of the whole overcoat layer.

9. The image forming apparatus of claim 8, wherein a content of the fluorinated resin particles range from 10% to 35% of the whole overcoat layer.

10. The image forming apparatus of claim 1, wherein the carrier has a magnetic property, and the developer carrying member includes a fixed magnet roller and a rotatable sleeve roller containing the magnet roller therein.

11. The image forming apparatus of claim 1, wherein an electric field for transferring the toner on the developer carrying member onto the toner carrying member is formed between the developer carrying member and the toner carrying member.

12. The image forming apparatus of claim 1, wherein a number average particle diameter of the opposite polarity particles range from 100 to 1,000 nm.

* * * * *